US009888768B2

(12) United States Patent
Weyler et al.

(10) Patent No.: US 9,888,768 B2
(45) Date of Patent: Feb. 13, 2018

(54) VERTICAL LIFT SYSTEM

(71) Applicants: Rand D. Weyler, Lynnfield, MA (US); Stephenie K. Harper, Somerville, MA (US); Richard R. Curran, Manchester, MA (US)

(72) Inventors: Rand D. Weyler, Lynnfield, MA (US); Stephenie K. Harper, Somerville, MA (US); Richard R. Curran, Manchester, MA (US)

( * ) Notice: Subject to any disclaimer, the term of this patent is extended or adjusted under 35 U.S.C. 154(b) by 71 days.

(21) Appl. No.: 14/605,954

(22) Filed: Jan. 26, 2015

(65) Prior Publication Data

US 2015/0136713 A1 May 21, 2015

Related U.S. Application Data

(63) Continuation of application No. 13/196,754, filed on Aug. 2, 2011, now Pat. No. 8,939,296.

(60) Provisional application No. 61/370,391, filed on Aug. 3, 2010.

(51) Int. Cl.
*A47B 46/00* (2006.01)
*A47B 51/00* (2006.01)

(52) U.S. Cl.
CPC ..... *A47B 46/005* (2013.01); *A47B 46/00* (2013.01); *A47B 51/00* (2013.01)

(58) Field of Classification Search
CPC ..... A47B 46/00; A47B 46/005; A47B 51/00
USPC ..... 211/1.51, 1.52, 1.53, 121, 122, 153; 108/20, 50.02, 106; 312/209, 268, 272.5, 312/306, 312, 319.5–319.8; 144/285, 144/286.1, 286.5; 198/347.1, 801; 414/331.14; 52/36.4; 254/93 L; 269/37
See application file for complete search history.

(56) References Cited

U.S. PATENT DOCUMENTS 5,107,636 A * 4/1992 Schindele ..... A61G 12/00 312/209
5,522,324 A * 6/1996 van Gelder ..... A47B 21/06 108/50.02

(Continued)

FOREIGN PATENT DOCUMENTS

WO WO 0024291 A1 * 5/2000
WO WO 2006112264 A1 * 10/2006 ..... A47B 51/00

*Primary Examiner* — Joshua Rodden
(74) *Attorney, Agent, or Firm* — Clay McGurk; The Law Office of Clay McGurk

(57) ABSTRACT

A vertical lift system provides an ergonomic system for raising and lowering a lift carriage which contains non-slidable and/or slidable shelves. By having interchangeable modular raceways providing electrical, liquid, vacuum, gas and/or data delivery systems, equipment and appliances can be easily connected to these delivery systems without interfering with the up/down movement of the vertical lift carriage. The vertical lift system also includes a height adjustable work surface which can be raised/lowered based on an individual's personal preference. Some of the shelves can be manually extended or electronically controlled. The vertical lift system also allows the monitoring, processing and collecting of data from multiple pieces of equipment. The vertical lift system can connect to local and global networks and systems, such as the Internet or other communication systems or networks, other shared equipment, and can monitor alarm and environment data.

11 Claims, 18 Drawing Sheets

(56) References Cited

U.S. PATENT DOCUMENTS

| | | | | | |
|---|---|---|---|---|---|
| 5,618,090 | A * | 4/1997 | Montague | A61G 12/002 | 211/26 |
| 5,994,644 | A * | 11/1999 | Rindoks | A47B 21/06 | 108/50.02 |
| 6,267,064 | B1 * | 7/2001 | Ostertag | A47B 13/021 | 108/108 |
| 6,836,910 | B2 * | 1/2005 | Cawthon | A22C 25/025 | 4/643 |
| 7,267,305 | B2 * | 9/2007 | Kreuzer | A61G 12/001 | 174/481 |
| 7,566,239 | B2 * | 7/2009 | Knappe | A61G 12/002 | 439/501 |
| 7,634,967 | B1 * | 12/2009 | Albright | H02G 3/386 | 108/50.02 |
| 2006/0230992 | A1 * | 10/2006 | Newhouse | A47B 9/18 | 108/147 |
| 2006/0249649 | A1 * | 11/2006 | Volk | B25H 1/02 | 700/213 |
| 2007/0204537 | A1 * | 9/2007 | Bastian | A47B 21/06 | 52/220.7 |
| 2008/0196334 | A1 * | 8/2008 | Mangiardi | A47L 11/302 | 52/220.8 |
| 2014/0238277 | A1 * | 8/2014 | Fishman | A47B 37/00 | 108/25 |
| 2015/0290646 | A1 * | 10/2015 | Rosenstein | B01L 9/02 | 312/209 |

* cited by examiner

VERTICAL LIFT SYSTEM

CROSS-REFERENCE TO RELATED APPLICATIONS

This application is a continuation of U.S. patent application Ser. No. 13/196,754 filed Aug. 2, 2011, which claims priority to U.S. Provisional Patent Application No. 61/370,391, filed on Aug. 3, 2010, all of which are incorporated herein by reference in their entirety.

BACKGROUND OF THE INVENTION

Most desks and workstations (such as used in offices and laboratories, for example) have fixed tables or countertops. Although there may be fixed shelves above the desk for storing a variety of items, one of the main problems with fixed shelves is the inefficiencies and underutilization of the area above (and below) the desk. It can be difficult, awkward and pose a variety of safety issues for reaching the top or bottom shelves to place objects or items thereon. Many people are forced to use ladders and step stools to place objects on the top shelves, and are forced to crouch, bend or kneel for placing objects on the bottom shelves. This of course causes a host of problems (e.g., safety, ergonomics, efficiencies) associated with using a ladder or step stool, or when climbing and balancing on the ladder when objects are fragile, expensive or heavy, with both hands are being used to hold such objects instead of being used to aid in balancing while ascending the stairs. Therefore, what is needed is the ability to reach the top shelves without a ladder.

Another problem with a desk or a workstation countertop is that they are usually made for a person of average height. This poses ergonomic problems for people who are taller, smaller and for those who want more/less space for their legs or for resting their arms thereon. What is needed therefore is a desktop or workstation countertop where the height of the desktop or workstation countertop can be easily adjusted to an individual's personal preference.

Another problem with fixed shelves is the inability to place active equipment or components thereon without using a number of long extension cords, connections and/or pipes. Active equipment refers to machines, tools, devices, appliances or gadgets that use electricity, liquids, gas, vacuum and/or data, for example, and that are being used in an office, running a business, experiments, research, development, design or other laboratory research. There are no convenient outlets located on or near the shelves, making it difficult to plug active equipment into an electrical outlet or connecting them to liquids (e.g., water) or gas (e.g., nitrogen, vacuum, oxygen, helium) or data systems (e.g., the Internet, a local computer network). What is needed therefore is an efficient way to connect to, and to remove and change the outlets, plumbing or services available for a shelving system.

During an experiment using active equipment on a fixed shelving system, there arises a problem on how to effectively and efficiently dispense of used waste materials, such as liquids (water, for example) and gases (helium, for example). What is needed is an efficient way of disposing of waste during live and active experiments on a shelving system.

What is needed is a shelving system that solves these problems, where a ladder is not needed for the storing objects on the top shelves, where equipment can be easily and ergonomically accessed and connected to power, liquid and gas outlets, and where waste can be efficiently disposed during active experiments.

SUMMARY OF THE INVENTION

The vertical lift system of the present invention consolidates and efficiently integrates into a single system an ergonomic work area, shelves that can be raised, lowered and extended forward/backward, storage of active equipment, and a height adjustable work surface. This system forms a single, efficient desk, system or other equipment storage system that increases productivity and maximizes storage vertically in a compact footprint. The vertical lift system also allows the monitoring, processing and collecting of data from multiple pieces of equipment. The vertical lift system can connect to local and global networks and systems, such as the Internet or other communication systems or networks, other shared equipment, and can monitor alarm and environment data.

In a laboratory type of environment for example, each shelf in the vertical lift system can be considered to be an active work space where all the active work spaces (i.e., shelves) can be put into storage. In other words, each shelf or work space can contain a separate (or combined) laboratory test or experiment, where each test or experiment involves different pieces of equipment or appliances. This allows each shelf (i.e., work surface) to become a work area for active equipment or appliances that can be stored out of the way when another shelf (i.e., work surface) is needed at the user's ergonomic height. The vertical lift system efficiently permits the equipment to be locally connected or coupled at or near the work space to electricity, data, liquid, gas, air and/or vacuum. So instead of having the experiments at different places on a single work surface, desk or countertop, each experiment can be efficiently and effectively put onto a separate shelf or work surface, and moved up/down for effectively accessing each of the on-going experiments.

A vertical lift system is provided and comprises a housing, a lift carriage located inside the housing, having one or more shelves and at least one modular raceway, each modular raceway providing delivery of electricity, data, vacuum, liquid or gas, and a lift system coupled to the lift carriage and the housing, having a control unit that controls movement of the lift carriage inside the housing.

A vertical lift system is provided and comprises a housing, a lift carriage located inside the housing, having one or more shelves and at least one modular raceway, each modular raceway providing delivery of electricity, data, liquid or gas, a lift system coupled to the lift carriage and the housing, and a control unit coupled to the lift system.

A vertical lift system is provided and comprises a housing, a lift carriage located inside the housing, having one or more shelves and at least one modular raceway, each modular raceway providing delivery of electricity, data, liquid or gas, a work surface connected to the housing and having a unit for moving vertically the work surface, a lift system coupled to the lift carriage and the housing, the lift system controlling vertical movement of the lift carriage, and a control unit for controlling the lift system, for controlling vertical movement of the work surface and for controlling extension of the one or more shelves.

An object of the present invention is to provide a vertical lift system that can be lowered/raised so that the top shelves can be easily and ergonomically accessed and objects placed thereon.

Another object of the present invention is provide a vertical lift system where the height of a work surface or a countertop can be individually adjusted to an individual's personal preference.

Still another object of the present invention is to provide a vertical lift system where equipment can be easily accessed and connected to electrical, liquid, gas, vacuum and/or data outlets/valves.

Yet another object of the present invention is to provide a vertical lift system where the electrical, liquid, gas and/or data outlets/valves can be easily changed from one delivery system to another.

Another object of the present invention is to provide a vertical lift system where waste disposal can be easily disposed of during live and active experiments.

It is to be understood that both the foregoing general description and the following detailed description are exemplary and explanatory and are intended to provide further explanation of the invention as claimed and not to limit it.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
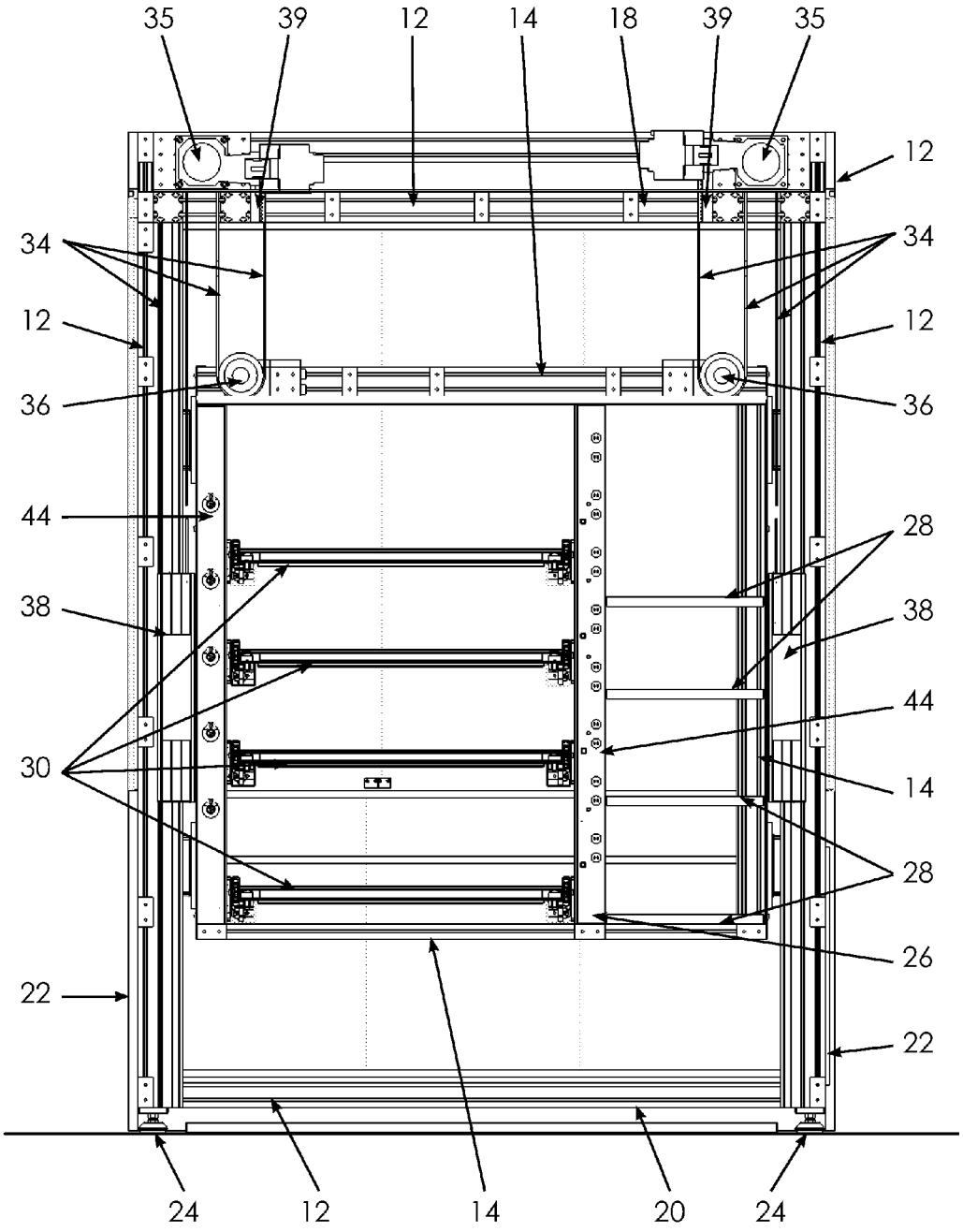
FIG. 1 illustrates a front, two dimensional view of a vertical lift system according to an embodiment of the present invention.

FIG. 1 illustrates a front, two dimensional view of vertical lift system 10 according to an embodiment of the present invention. System 10 comprises housing 12, lift carriage 14 and lift system 16. Housing 12 encloses or surrounds lift carriage 14 and encloses or supports lift system 16. Housing 12 is preferably rectangular in shape, and made from steel, although other shapes and materials can be used. Housing 12 comprises top 18, base 20 and at least two sides 22. Each of top 18 and base 20 can comprise four sides (forming a rectangle or square) joined together by nuts/screws, welding, or any other means for securely holding the sides together. Base 20 may rest directly on floor, or may be mounted to feet 24, where one foot 24 is connected to each corner of base 20. Base 20 is optional, since sides 22 may form legs to rest on a floor, and alternatively, may also have a steel plate running between the two columns 22 to provide extra support and stability without the need for base 20.

Each of sides 22 attach to top 18 and base 20. Each side 22 comprises at least two columns, where each end of the two columns attach to top 18, and the other end of the two columns attach to base 20. The columns of sides 22 are preferably made from steel or a durable, strong, or heavy-duty metal or other material. Alternatively, sides 22 can comprise four sides (forming a rectangle or square) joined together by nuts/screws, welding, or any other means for securely holding the sides together. It can be appreciated that each of top 18, base 20 and sides 22 can be covered with or attach to any type of protective shell, cover or decoration, such as metal, plastic or wood, for example.

Figure 2:
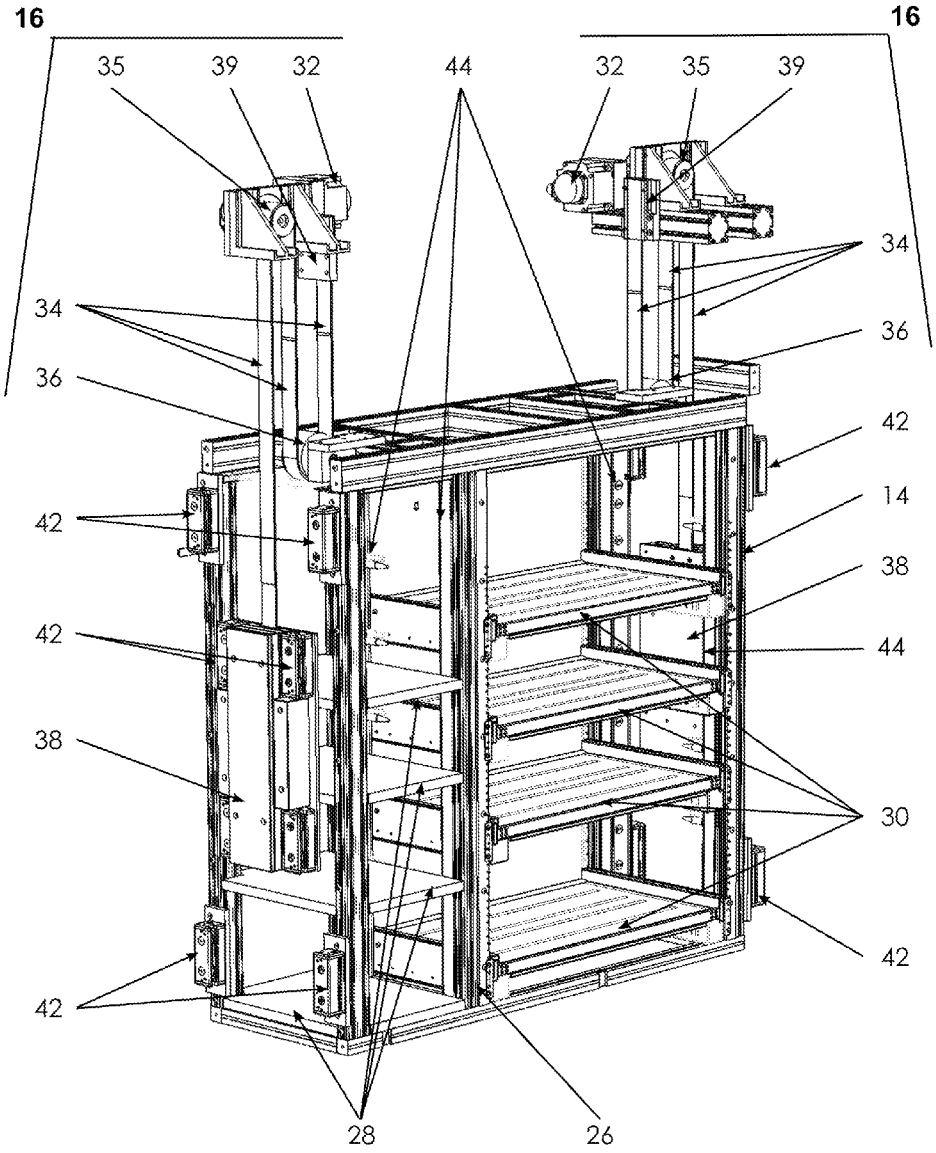
FIG. 2 illustrates a front perspective view of a lift carriage of a vertical lift system according to an embodiment of the present invention.
Figure 3:
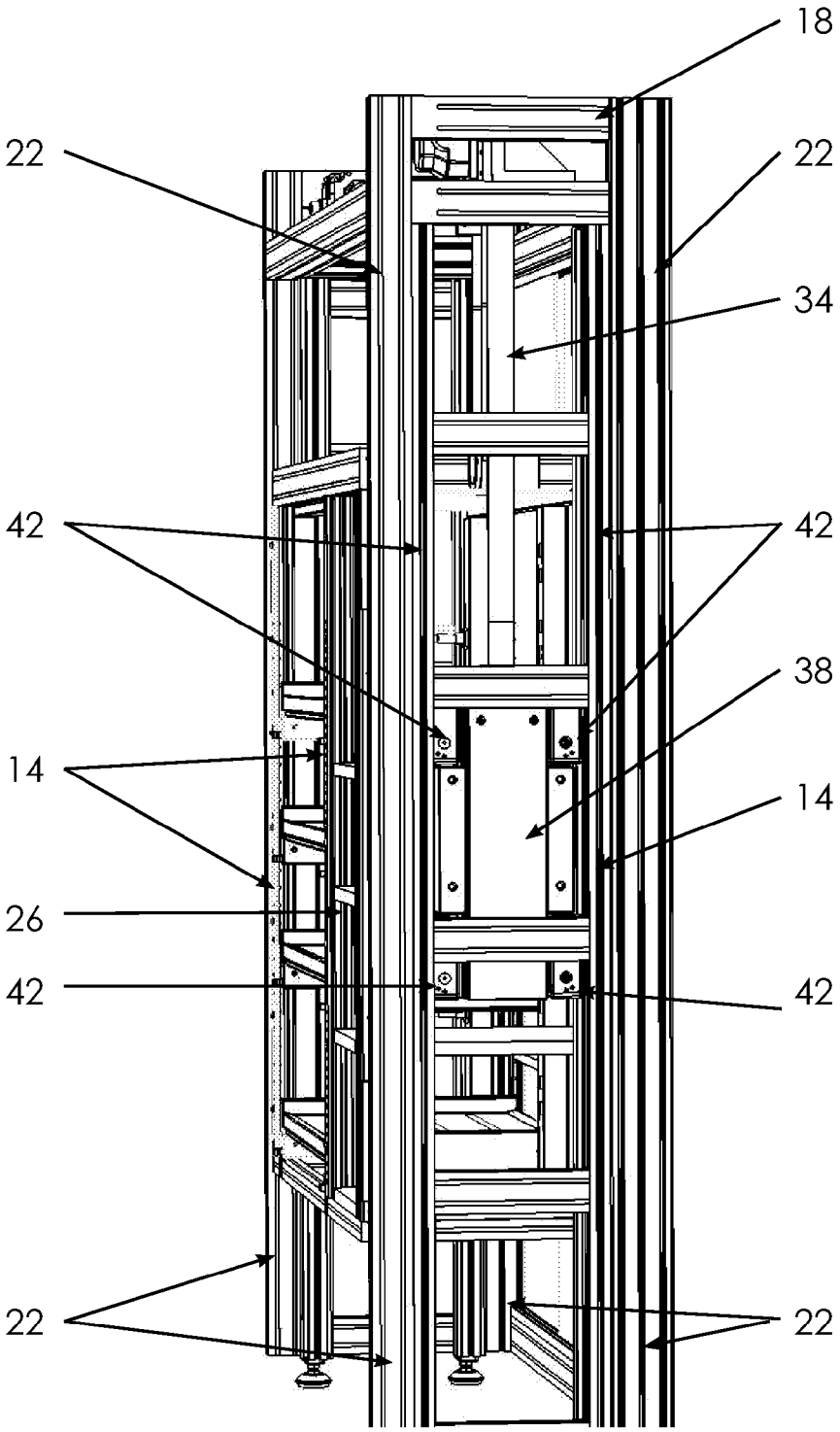
FIG. 3 illustrates a side perspective view of vertical lift system according to an embodiment of the present invention.

FIG. 2 illustrates a perspective view of lift carriage 14 of a vertical lift system according to an embodiment of the present invention. FIG. 3 illustrates a side view of vertical lift system according to an embodiment of the present invention. Lift carriage 14 comprises a frame as shown in FIG. 2, having a front and back rectangular (or alternatively, square) sections, where the front and back sections are joined via a cross-beam at various places along the top and bottom of the frame. Columns 26 provide support between non-slidable shelves 28 and slidable shelves 30. Slidable shelves 30 can move out or in manually or automatically under electronic control. Columns 26 are optional, as lift carriage 14 can comprise all non-slidable shelves 28 without any slidable shelves 30, all slidable shelves 30 without any non-slidable shelves 28, or a combination of non-slidable shelves 28 and slidable shelves 30. The frame of lift carriage 14 is preferably made from metal (such as steel for example), but other types of metals and materials may be used, including plastic and wood, for example.

As shown in FIGS. 1-3, lift carriage 14 moves up/down in the vertical direction inside of housing 12 via lift system 16.

Lift system 16 comprises at least one motor 32, at least one belt 34, at least one gear 35, pulleys 36, at least one counterweight 38, at least one clamp 39 and control unit 40. Motor 32 drives a shaft (located behind gear 35 in FIG. 2) which rotates gear 35, forcing belt 34 to move in one of two directions. The movement of gear 35 forces belt 34 to move, putting force to rotate pulleys 36 and to move counterweight 38 up/down, resulting in either raising or lowering lift carriage 14. Counterweight 38 moves in the opposite direction from lift carriage 14, where counterweight 38 would rise while lift carriage 14 would be lowered, for example. Belt 34 is securely attached or connected at one end to counterweight 38 and securely attached or connected at the other end to clamp 39.

Bearing blocks 42 are attached to the frame of lift carriage 14, each having wheels which slide along a track formed inside the columns of sides 22. Through the use of two motors 32, two belts 34, two counterweights 38 and bearing blocks 42 as shown in FIG. 2, lift system 16 provides a smooth motion either in lowering or raising lift carriage 14 and significantly reduces vibration during the movement. Motors 32 are preferably located at the top 18 of housing 12. Motors 32 are electronically controlled (via a direct, wired connection or wirelessly) by control unit 40 (not shown) for raising and lowering lift carriage 14 of lift system 16. It can be appreciated that other types and configurations of lift system 16 could be alternatively used as well, including hydraulics, or motors in combination with chains/belts, for example.

Non-slidable shelves 28 and slidable shelves 30 can be used for storing any object or item (e.g., supplies or active equipment in a laboratory). Both non-slidable shelves 28 and slidable shelves 30 are contained inside lift carriage 14. Each non-slidable shelf 28 and slidable shelf 30 can provide spill containment by having a lip or gutter at the edge of the four corners of the shelf. Each non-slidable shelf 28 and slidable shelf 30 can be adjusted in height along lift carriage 14 by using any variety of pilasters or standards, in combination with clips, supports, brackets (e.g., flanged brackets, lock lever brackets, lever locks), or other commercially available mechanisms. Shelves 28, 30 can be made from any durable material, including but not limited to, steel, aluminum, other metals, plastics, wood, glass, epoxy, phenolic or any combination therewith. Slidable shelves 30 are explained in more detail below.

Although it is preferred that lift system 16 be electronically controlled via control unit 40, in other embodiments, lift system 16 may only comprise parts/pieces that are manually (i.e., physically) controlled. For example, instead of having motor 32, there may be a hand-crank or other hand-operated mechanism attached to a belt, whereupon the turning of the crank will move the belt, gears, pulleys and counterweight. A latch or stop will hold the hand-crank in place so as to prevent rotation.

Figure 4:
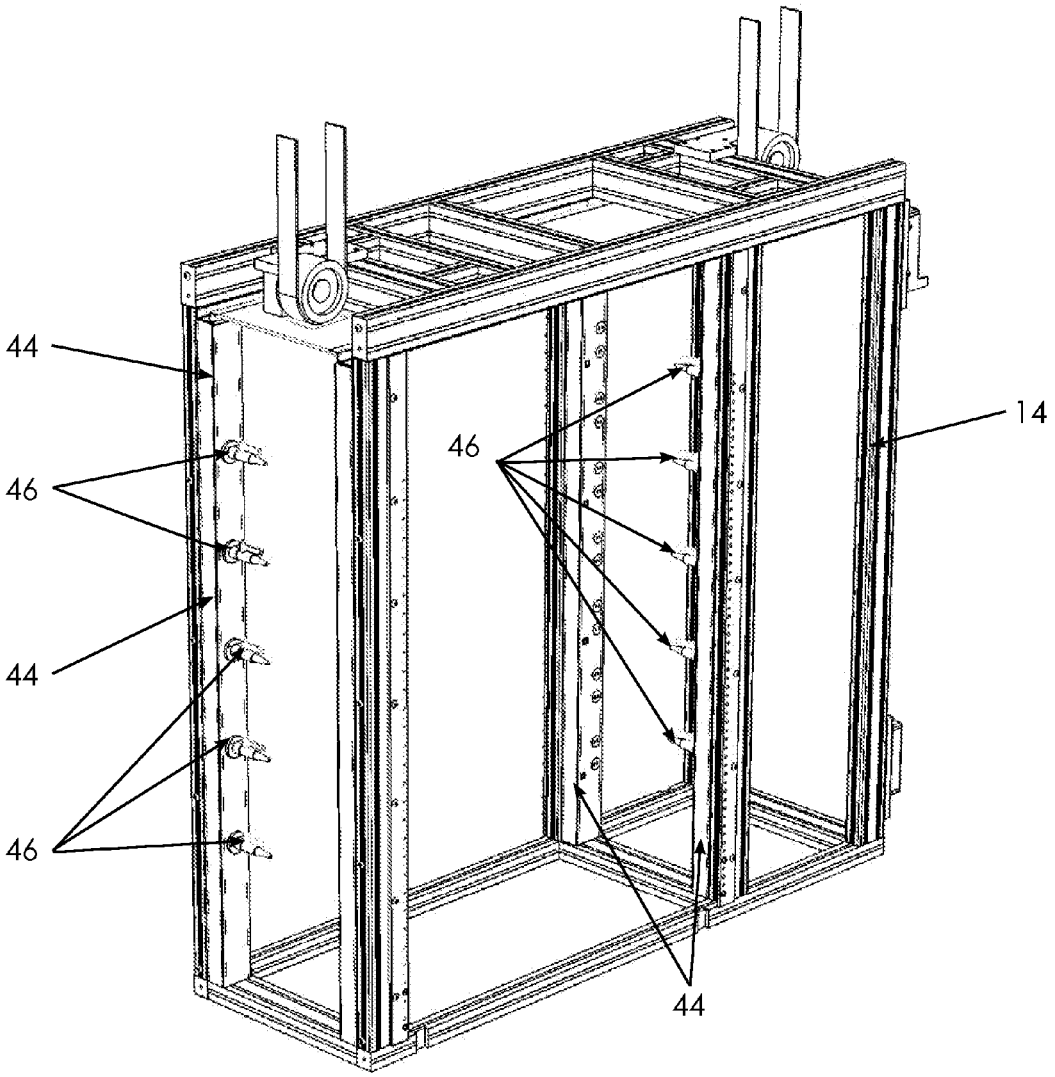
FIG. 4 illustrates modular raceways according to an embodiment of the present invention.

FIG. 4 illustrates modular raceways 44 according to an embodiment of the present invention. FIGS. 1 and 2 also show modular raceways 44 which are connected inside lift carriage 14. Modular raceways 44 connect active equipment on shelves 28, 30 to the delivery of electricity, plumbing (e.g., gas, water, air, waste or vacuum), and/or data systems or networks. Such electrical, plumbing and data systems and/or networks may be local to the vertical lift system 10, part of a building's system, or part of any other public or private network or system. Modular raceways 44 comprise electrical raceways, plumbing raceways, waste (or disposal) raceways, data raceways or any other raceway for delivering specific types of liquid, electricity, gas, vacuum and/or data. Modular raceways 44 are interchangeable, meaning that an electrical raceway could be replaced by a plumbing raceway and visa versa. Also, if four raceways were installed on lift carriage 14, each raceway could be used to serve a different delivery system, i.e., electrical, water, gas and data. Moreover, it can be appreciated that multiple delivery systems can be combined into a single modular raceway (e.g., plumbing and gas provided in one modular raceway). Another example may be to combine outlets for electrical power and data systems into a single modular raceway.

These modular raceways 44 connect to a source's (e.g., workstation's or building's) plumbing, electrical or data systems at the top of the raceway, through the top of lift carriage 14 and then through the top 18 (or alternatively the sides 22) of vertical lift system 10 to connect to the source. It can be appreciated that modular raceways 44 can also connect at the bottom of lift carriage 14 and through the bottom and/or side of system 10. Each modular raceway 44 connects to lift carriage 14 via any type of connection, including snap locks, clips, buckles, nuts/bolts, or any commercially available means for attaching modular raceway 44 to lift carriage 14.

As shown on FIG. 4, a plumbing raceway 44 comprises at least one pipe (flexible or hard, metal or plastic) with a variety of plumbing valves 46. Plumbing valves 46 can be interchangeable, removable, and/or quick-connect fixtures and can be located above and/or underneath shelves 28, 30. Plumbing valves 46 can be found inside lift carriage 14 and are capable of being connected to a building's or laboratory's water, gas or other liquid/gas/air/vacuum systems via pipes or hoses which run through the top of lift carriage 14 and through the top or sides of vertical lift system 10. Plumbing valves 46 are connected to the pipes inside modular raceway 44. A separate tube or pipe is used for connecting plumbing valves 46 to an input valve on the equipment stored on shelves 28, 30. In one embodiment, plumbing valves 46 may include an extendable fixture that extends from modular raceway 44 to the equipment being connected.

Plumbing valves 46 provide an efficient system and method for attaching the water and/or gas systems to equipment that is stored on shelves 28, 30. Although the plumbing valves 46 are oriented in FIG. 4 in a position facing inward to the center of lift carriage 14, valves 46 may also be oriented in a direction perpendicular to that shown in FIG. 4 or in any other position. Plumbing valves 46 may be made from metal or plastic, and can have a locking mechanism to lock the tube or piping from the equipment onto the plumbing valve 46. Plumbing valves 46 can also have a local shut off lever, push or lift to turn safety features, or any other commercially available feature(s).

Modular raceways 44 may also house electrical outlets and data connections. The electrical outlets can be any configuration commercially available including NEMA, while the data outlets can be Ethernet, USB or any other type of data connection outlet. The electrical outlets provide an easy and efficient way to plug electrical or electronic equipment into a power source or into a data source (such as the Internet, a computer, a server or any other type of data device, service, system or network). A power modular raceway 44 is wired at the top of lift carriage 14 so it can be easily connected to the power or data source (e.g., laboratory's or building's electrical power source and data lines). Modular raceway 44 may have quick connections, such as a twist lock feature for example, but could also be hard connected to the building system rather than modular if so desired. Optionally, the equipment may be connected to a wireless server or to a wireless local access network, thus eliminating the need for data connection in the modular raceways 44.

Modular raceways 44 may also comprise drainage pipes that can be connected to drainage bins located at the bottom of vertical lift system 10. Drainage bins can be used for capturing waste from laboratory experiments or otherwise. Drainage bins are made of materials used for capturing a particular waste, whether made of metal or plastic materials, and for collecting liquids or gas or a combination thereof. The floor of vertical lift system 10 may be dished to contain any accidental spills and for easy cleaning.

Modular raceways 44 are located on lift carriage 14, so when lift carriage 14 moves up/down, modular raceways 44 also concurrently move up/down. This provides the advantage of knowing that the active equipment would not be disconnected from their electrical, liquid, gas data or other source due to the movement of lift carriage 14 in system 10. This also provides a convenient way to connecting active equipment to a source without undue use of extension cords, wires, pipes and/or tubes.

In an alternative embodiment, modular raceways 44 could be fixed inside lift carriage 14, meaning that modular raceways 44 are not interchangeable and/or removable. This may be due to certain code rules and regulations enacted by local, state and federal jurisdictions. For example, vertical lift system 10 may contain a permanent modular raceway 44 for housing electrical outlets and wires. In another example, vertical lift system 10 may contain a permanent electrical raceway and a permanent liquid raceway for waste. In another alternative embodiment, modular raceways 44 may have a combination of permanent raceways and interchangeable raceways.

In another embodiment, there may be a strip of outlets that runs along the back, sides and/or the bottom of the shelf or may be integrated into the shelf itself. This strip or strips would connect to the modular raceways 44, or connect wirelessly, or with wires to the building service delivery system. This configuration effectively multiples the number of outlets for each outlet on the modular raceways 44. For example, instead of having one electrical outlet per each shelf, a power strip having multiple outlets could be placed along the back or sides of each of the shelves, thus multiplying the number of available outlets per one outlet on the modular raceway. These power strips permit each piece of equipment or appliance to connect to their own power outlet. Instead of having one electrical outlet for all pieces of equipment and appliances on a single shelf (i.e., work surface), multiple outlets become available for use by the equipment and appliances. Similar strips can also be used for providing multiple outlets for liquids, gas, air, vacuum, waste, etc.

Figure 5:
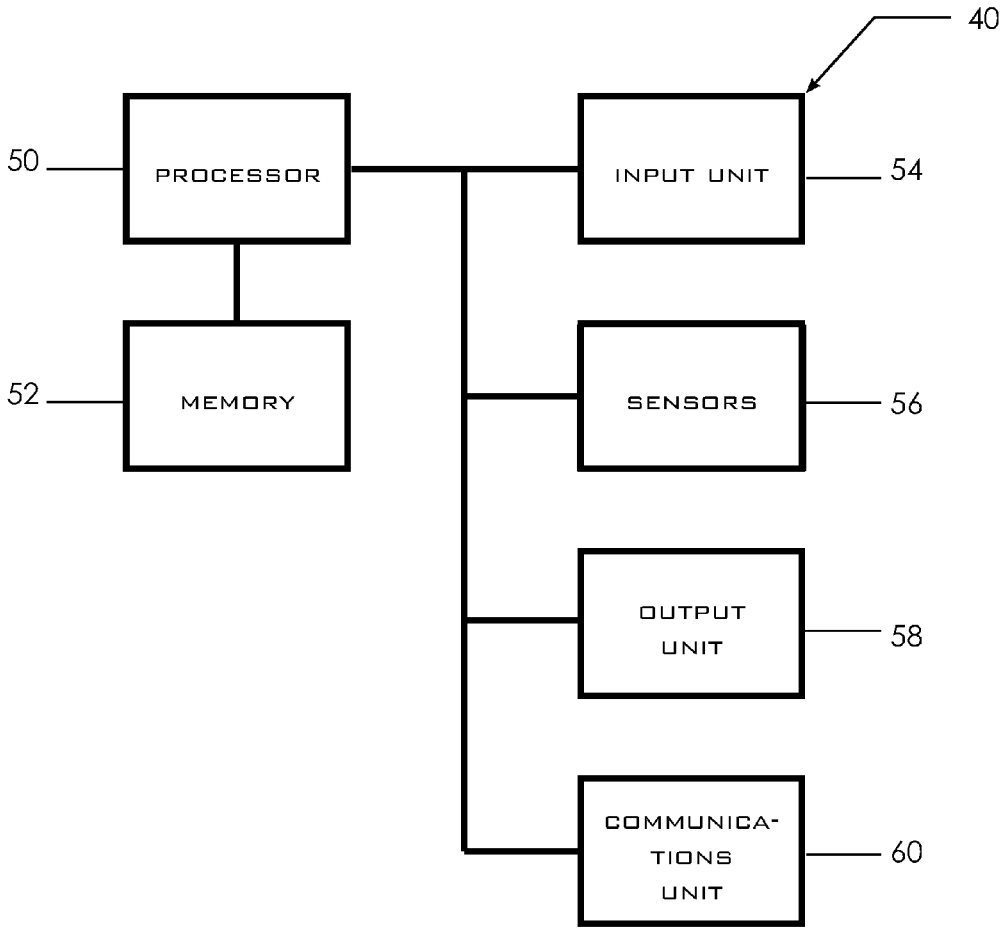
FIG. 5 illustrates a control unit according to an embodiment of the present invention.

FIG. 5 shows a control unit 40 according to an embodiment of the present invention. Control unit 40 may or may not be part of lift system 16, but instead may be a separate unit apart from the lift system 16. Lift system 16 brings each piece of equipment that is stored on shelves 28, 30 in a safe and smooth vertical motion. Lift carriage 14 moves in the vertical direction (up/down or raise/lower) under the control of control unit 40. Control unit 40 can comprise one or more computers or servers. Control unit 40 not only controls lift carriage 14 and slidable shelves 30, but also all other functions and features of vertical lift system 10, including for example, turning on/off interior and exterior lights, activate/deactivate switchable glass, power vertical lift system 10 on/off, and adjust the height of work surface 70.

Control unit 40 comprises processor(s) 50, memory 52, input unit(s) 54, sensors 56, output unit(s) 58 and communications unit(s) 60. Processor 50 can be any computer processor that is commercially available. There can be one or more processors 50, including having a processor dedicated to one or more particular functions. For example, there may be one processor 50 for controlling lift carriage 14, and a separate processor 50 for controlling the safety features and functions of vertical lift system 10.

Memory 52 can comprise any type and number of computer memory devices that are commercially available, such as internal or external memory disc drives and flash drives, for example. Memory 52 is primarily used to storing computer software, programs, applications and/or data that are executed on processor 50. Memory 52 may be incorporated into and part of processor 50, or may be a separate unit.

Input unit(s) 54 can comprise one or more buttons, keypads, joy sticks, mouse(s), keyboards or touch screens or other types of input devices used in a computer system. Each of the input unit(s) 54 can be made of metal, plastic or any other material suitable for the particular function, and may even light up and be visible when the environment is dark. Input unit(s) 54 could be digital, touch screen, switch or push button types and can have user definable set points or purposes.

Input unit(s) 54 can be located on the front, back or sides of vertical lift system 10. In one example of input unit 54 comprising a number of buttons, one button may be used for raising lift carriage 14, one button for lowering lift carriage 14, one button for an emergency stop, one or more buttons for turning on different lights mounted inside system 10 or the room, buttons for lifting an desk top, countertop or work surface, and buttons for opening and closing sliding doors or shelves. A keypad or keyboard may be used for entering a personal code to gain authorized access to system 10. All the features previously described in conjunction with the buttons and keypads, can be also programmed into and performed by a touch screen display device. A touch screen can also be programmed to monitor and manage any function or feature of vertical lift system 10.

Sensors 56 (or encoders 56) monitor any type of a change in a condition in vertical lift system 10 and determine the position/location of where lift carriage 14, slidable shelves 30 and work surface are separately located and in relation to each other. Sensors 56 can be any type of sensor or encoder, including for example, position sensors which can be used for detecting the location of the shelves 28, 39 or lift carriage 14 within vertical lift system 10, or the position of the work surface. There may be encoders for each motor used in vertical lift system 10, each encoder would determine the location or position of the lift carriage 14, slidable shelves 30 or work surface. Heat sensors can be used for detecting the temperature inside or around vertical lift system 10, such as used for detecting a fire for example. Gas sensors may be used for detecting the presence of a particular gas within vertical lift system 10, such as for detecting the release of a toxic or non-toxic gas. Water sensors may be used for detecting whether water is leaking in one of the modular raceways. Pressure sensors may be used for detecting whether pressure is being maintained on particular water or gas pipelines in modular raceways 44 for example. Electrical sensors may be used for detecting whether a constant current is being provided, so as to access a backup electrical power source in case of a power outage.

Output unit(s) 58 comprise any type and one or more monitors, display devices, lights, ventilation vents or fans, and motors (for raising/lowering lift carriage 14, raising/ lowering an adjustable work surface, and for controlling movement of slidable shelves 30). There can be multiple display devices located on vertical lift system 10 where such display devices can be located on the front, back and sides of system 10. When a touch screen is used for input unit 54, the touch screen may concurrently serve as output unit 58.

Communications unit(s) 60 can be a wired or wireless connection and/or port for connecting to any local, remote, public and/or private remote communications and/or computer networks, such as the phone networks (e.g., landline, cellular, satellite), local access computer networks, the Internet and any other type of wired or wireless networks or systems. There may be one or more communication units or ports 60 connected or coupled to control unit 40.

Via control unit 40, lift carriage 14 can be lowered so that any one of the upper shelves 28, 30 can be easily reached without a ladder. This enables users to place equipment and/or supplies on shelves 28, 30 in an efficient manner and without straining to reach the upper shelves. From these examples, any one can efficiently and easily place items and equipment on any of the shelves 28, 30.

Although vertical lift system 10 can be a stand-alone system, vertical lift system 10 can easily fit behind all types of conventional desks to provide a vertically movable unit for storing a variety of objects. Vertical lift system 10 may also have a fixed or a height adjustable work surface 70. Work surface 70 is similar to a desk top or countertop. If work surface 70 is manually adjustable up/down, pilasters or standards can be attached to the front (or alternatively, the side or back) of housing 12, in association with clips, supports and/or brackets (e.g., flanged, lock lever, lever lock) to hold a flat surface thereon to create work surface 70. This manually adjustable configuration allows for adjustment of work surface 70 by manually raising or lowering the brackets and/or supports to different locations on the pilasters, standards or along the housing 12.

Figure 6:
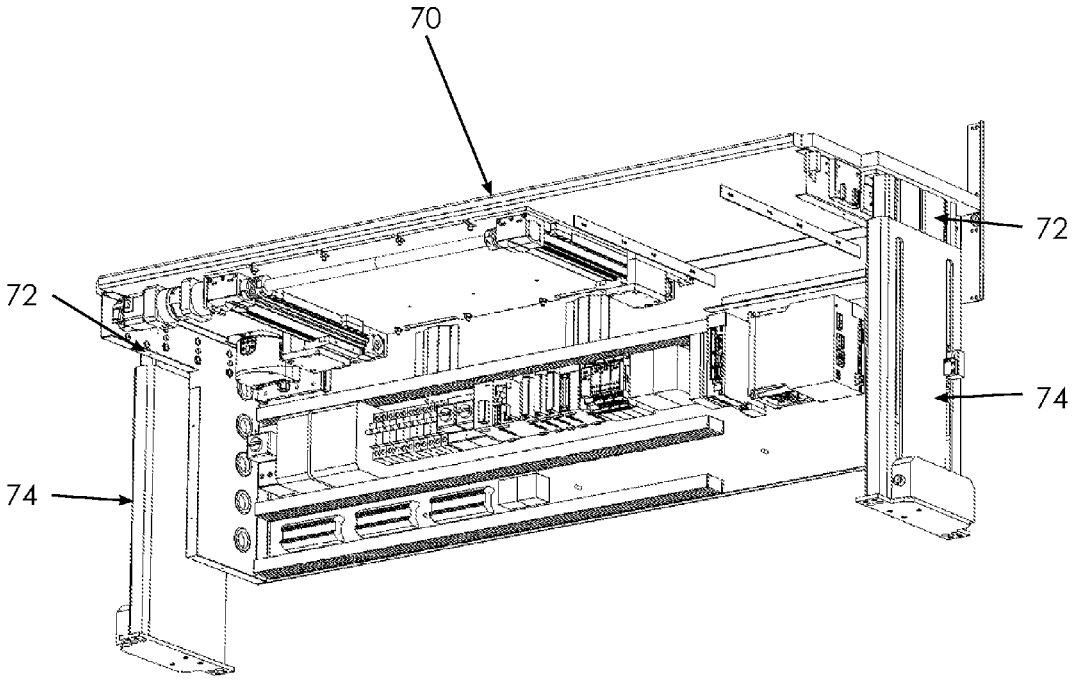
FIG. 6 illustrates a front perspective view of a height adjustable work surface according to an embodiment of the present invention.
Figure 7:
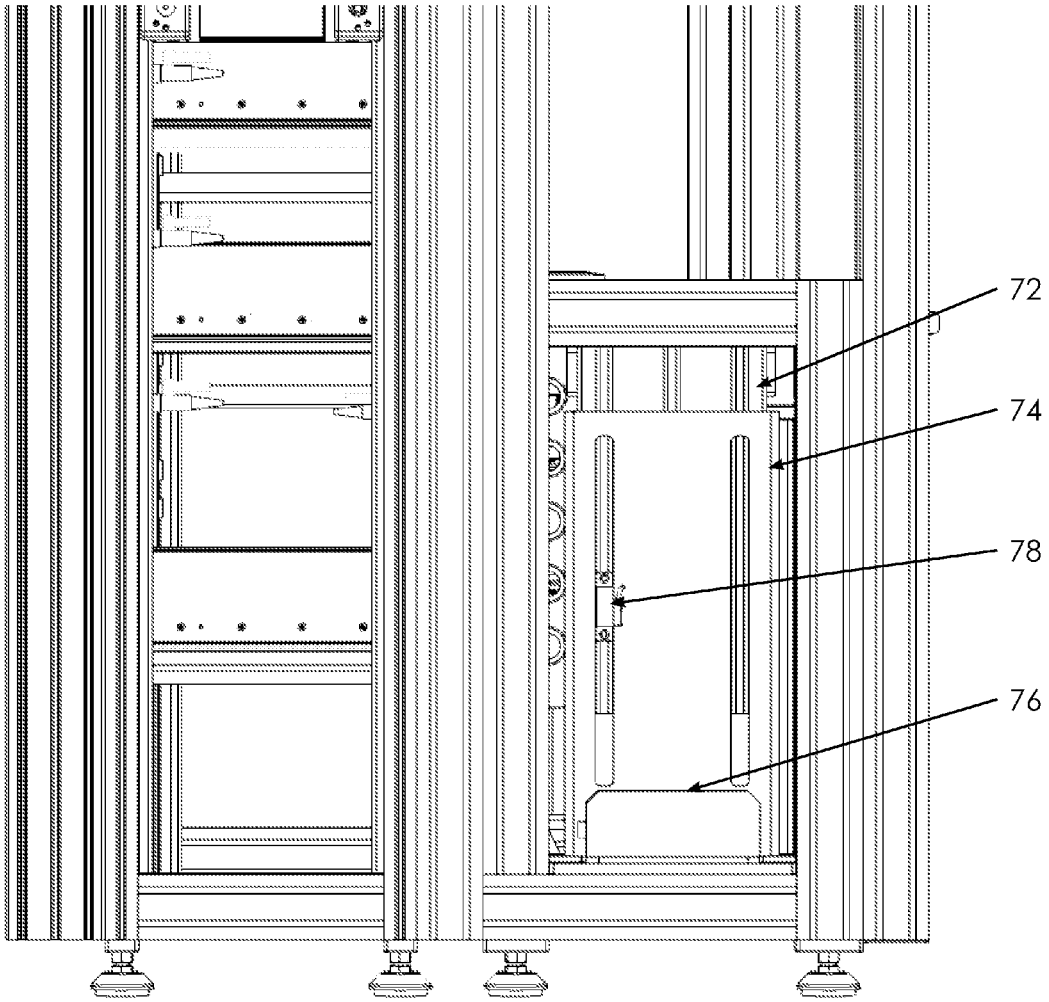
FIG. 7 illustrates a view of a leg of a height adjustable work surface according to an embodiment of the present invention.

FIGS. 6-7 illustrate a height adjustable work surface according to an embodiment of the present invention. Up/down buttons associated with control unit 40 can be located on the front, top or side of work surface 70 and can be used for raising or lowering the height of work surface 70. Alternatively, a touch screen of control unit 40 can display the current height, and a user could select a different height of work surface 70 via arrows (up/down arrows) or entering a number representing the actual height of work surface 70 from the floor. Control unit 40 can also be programmed to store the preferred height for each user, where the user could choose this setting and work surface 70 would then be automatically adjusted to the height preferred by the user.

As shown in FIGS. 6 and 7, adjustable work surface comprises work surface 70, movable leg sections 72, fixed leg sections 74, one electric motor 76 for each leg and sensors 78. There are at least two legs that support work surface 70. Each leg has leg section 72 that fits inside and moves inside fixed leg section 74. Control unit 40 controls the movement of both leg sections 72, which are raised or lowered together via motor 76. In each leg, motor 76 is attached to a drive shaft (not shown) that connects to an actuator (not shown) and connects to leg section 72. To raise work surface 70, control unit 40 signals both motors 76 (one in each leg) to rotate their drive shaft in the same direction, so that the actuator in each leg will rise together, thus raising work surface 70 in a smooth motion. To lower work surface 70, control unit 40 signals both motors 76 to rotate the drive shaft in the opposite direction, where both actuators will lower concurrently, thus lowering work surface 70 in a smooth motion. In an alternative embodiment, instead of using motors, drive shafts, actuators, hydraulic systems or any other mechanical and/or electrical systems that can raise/lower work surface 70 could be used as well.

Work surface 70 is preferably made from steel (or similar material) for durability and vibration control, although other materials and metals could be used as well. One or more of the sensors 56 determine the height of work surface 70 which is sent to control unit 40. Control unit 40 can then raise/lower lift carriage 14 so that non-slidable shelves 28 and/or slidable shelves 30 are aligned with the top of work surface 70. Slidable shelves 30 can be pulled out or extended from inside lift carriage 14 either manually or via a power source, so that the bottom edge of slidable shelves 30 clears the top of work surface 70 by a small distance, for example, such as less than a half of an inch. By allowing the slidable shelves 30 to extend over work surface 70, it provides an easier, safer, more ergonomic way for loading and unloading equipment (and other objects or items) from slidable shelves 30.

Once non-slidable shelves 28 and slidable shelves 30 have been installed into lift carriage 14, control unit 40 will run an initial configuration software program in conjunction with one or more sensors 56 to determine the number and location of each of the shelves 28, 30 and the height of a work surface and to configure or set initially any other feature or function that is performed or monitored by control unit 40. Alternatively, user-defined set points can be individually programmed for locations of specific shelves 28, 30, for specific work surface 70 height locations or for any other custom defined adjustments. Once set, specific shelves 28, 30 can be selected via input unit 54 of control unit 40, whereupon lift carriage 14 will move up/down so that the selected shelf will align with the top of work surface 70.

Figure 8:
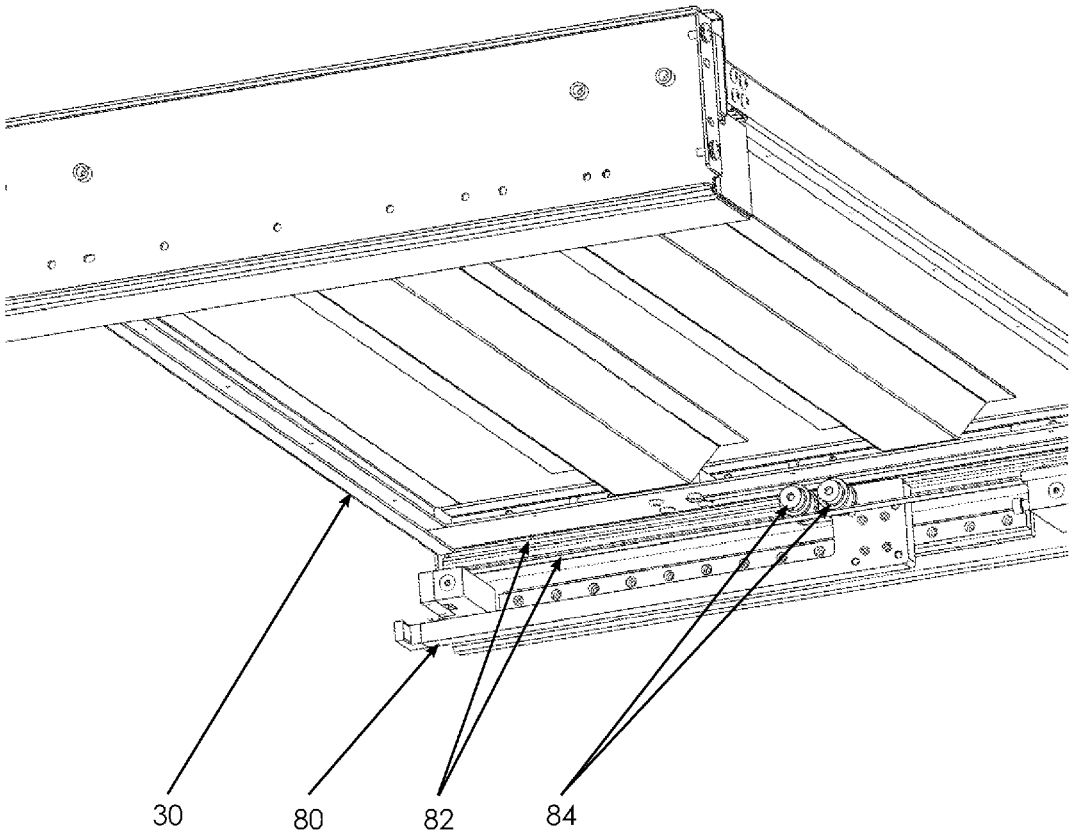
FIG. 8 illustrates a bottom perspective view of a movable shelf according to an embodiment of the present invention.
Figure 9:
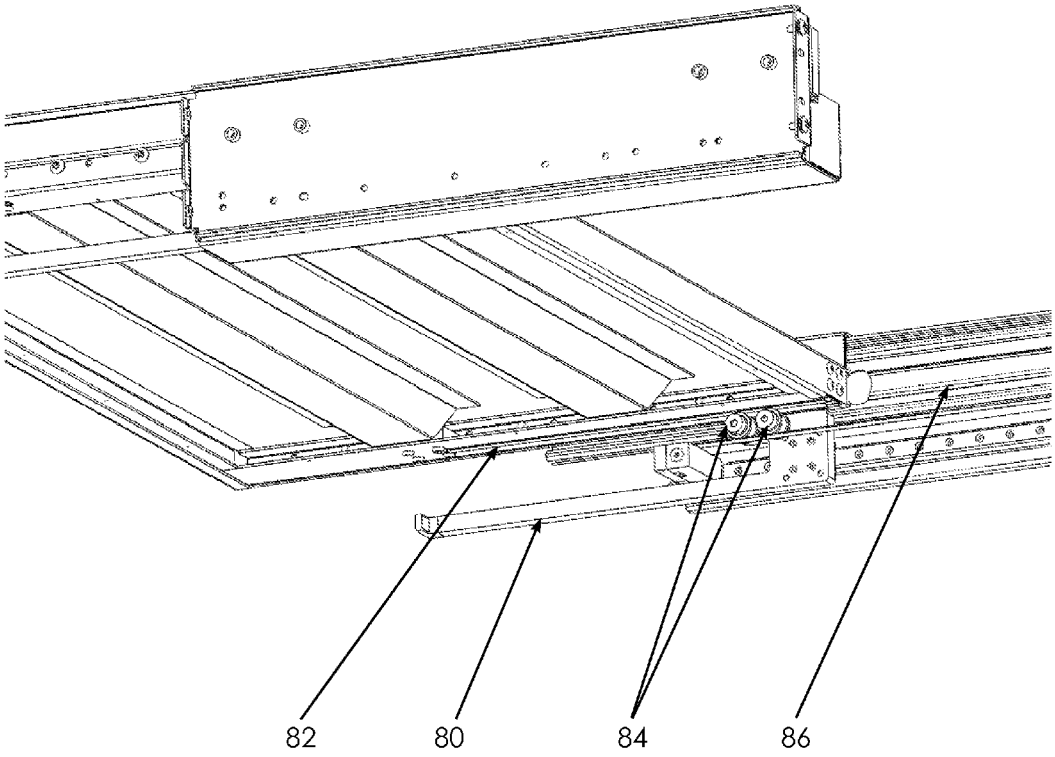
FIG. 9 illustrates a bottom perspective view of a movable shelf that is extended according to an embodiment of the present invention.

Slidable shelves 30 either slide manually or automatically via control unit 40. FIGS. 8-9 illustrate a bottom perspective of one side of slidable shelf 30. To extend slidable shelf 30 manually, a person pulls on shelf arm 80, which in turn forces bands 82 to retract around a pair of dual motion pulleys 84 forcing shelf 30 to slide along shelf slide 86. FIG. 8 illustrates slidable shelf 30 when retracted inside lift carriage 14, while FIG. 9 illustrates slidable shelf 30 when extended in the forward position from lift carriage 14. The dual motion pulleys 84 allow shelf 30 to extend twice the distance of shelf arm 80. Dual motion pulleys 84 can be used in the manual and/or the electronic configuration. In an alternative embodiment, shelves 30 may slide manually or automatically in the reverse direction, meaning instead of forward sliding, shelves 30 would be reverse sliding toward the back of vertical lift system 10. In yet another embodiment, shelves 30 may slide both in the forward and rearward directions via manual or electronic means.

Figure 10:
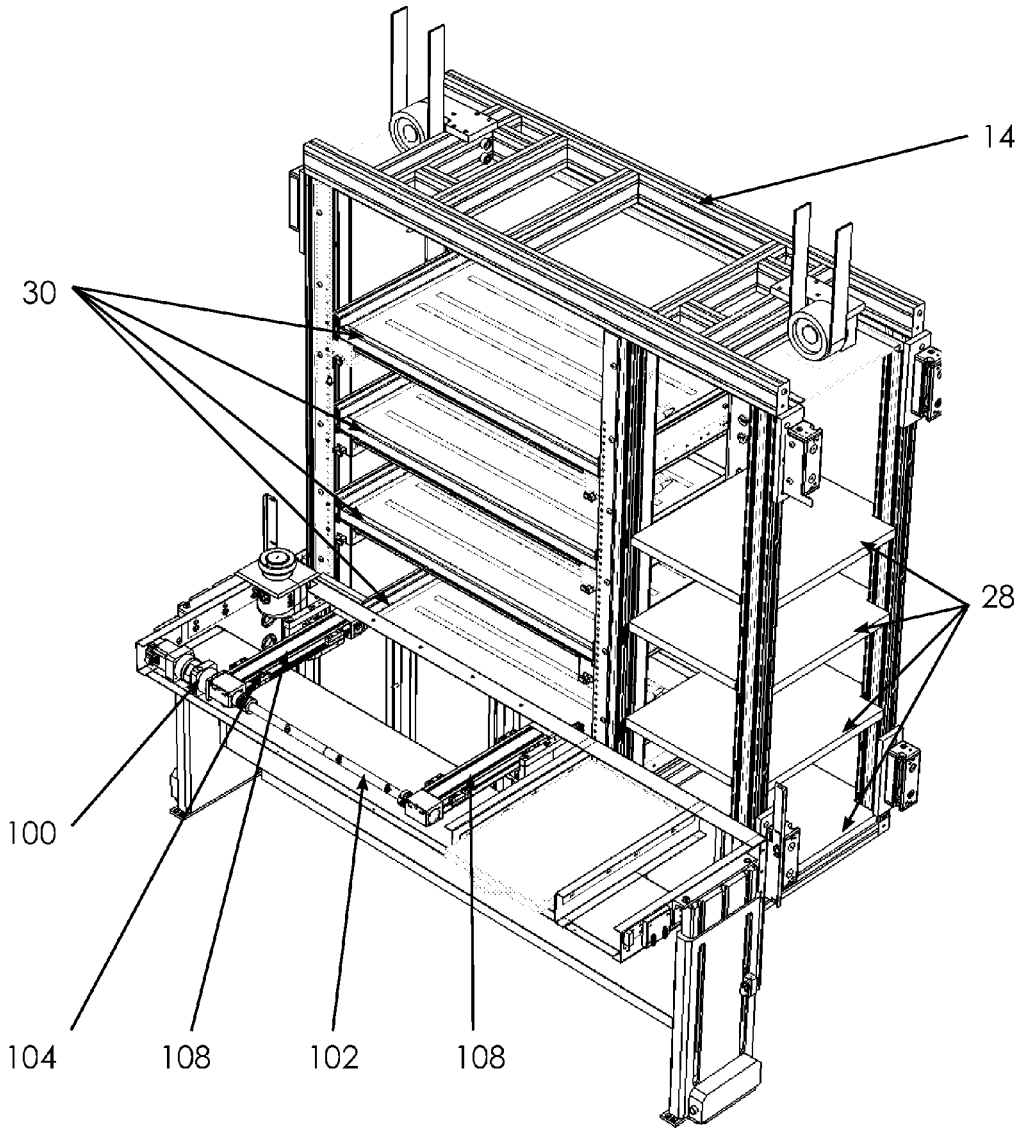
FIG. 10 illustrates a front perspective view of a lift carriage, work surface and a shelf motion unit for electronically controlling movement of a slidable shelf according to an embodiment of the present invention.
Figure 11:
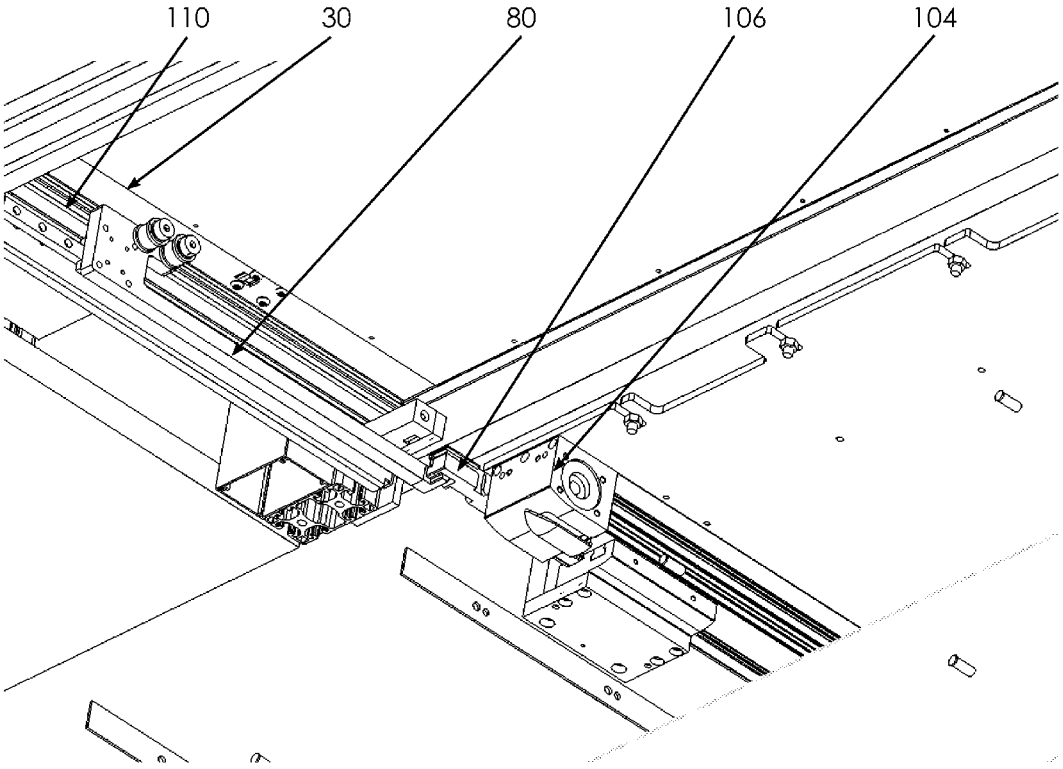
FIG. 11 illustrates a bottom perspective view of a shelf motion unit for electronically controlling movement of a slidable shelf according to an embodiment of the present invention.
Figure 12:
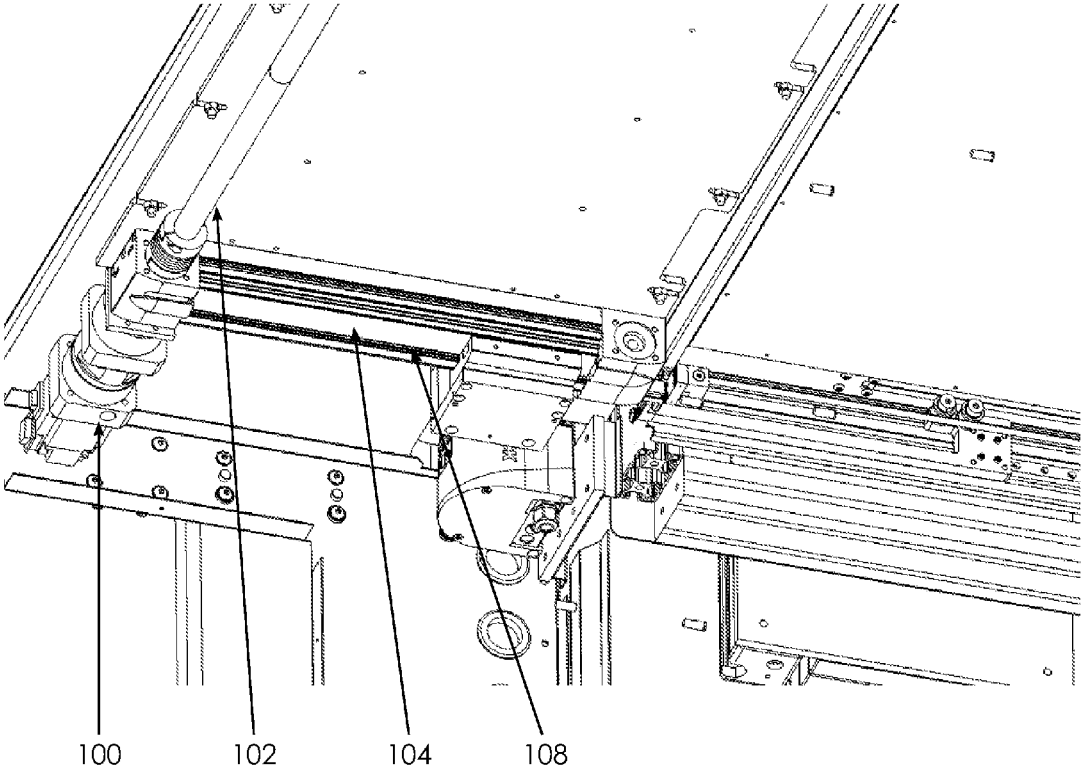
FIG. 12 illustrates a bottom perspective view of a shelf motion unit for electronically controlling movement of a slidable shelf according to an embodiment of the present invention.

FIGS. 10-12 illustrate a shelf motion unit for electronically controlling movement of slidable shelf 30. The shelf motion unit comprises actuator motor 100, drive shaft 102 and actuators 104. An actuator is a mechanical device for moving or controlling the movement of slidable shelf 30. Each slidable shelf 30 has a pair of shelf arms 80, one shelf arm 80 is shown in FIG. 11. At the end of shelf arm 80 is an "L" shaped piece, which engages or passes through the associated shelf receiver 106 (located underneath work surface 70) when lift carriage 14 is raised/lowered. After lift carriage 14 has moved so that the selected shelf 30 is properly aligned with work surface 70, each L-shaped piece of the shelf arm 80 engages, couples or connects to its respective shelf receiver 106. Actuator motor 100, under control of control unit 40 which receives a command to extend slidable shelf 30, then starts to rotate drive shaft 102 forcing actuator 104 to move along track 108, pulling slidable shelf 30 along track 110 (one on each side of shelf 30) from inside lift carriage 14. Motor 100 will stop once slidable shelf 30 has been fully extended.

When slidable shelf 30 needs to be retracted, an operator will indicate such operation to control unit 40 through any of the input units 54 previously mentioned, such as a button, or a touch screen button, for example. Thereupon, control unit 40 will signal to actuator motor 100 to rotate drive shaft 102 in the opposite direction, thereby pushing actuators 104 which in turn push slidable shelf 30 back into lift carriage 14. Once fully retracted, control unit 40 can raise/lower lift carriage 14, where shelf arms 80 can safely pass through shelf receivers 106.

The command to pull or push slidable shelf 30 can be automatically programmed into control unit 40 for each slidable shelf 30. Control unit 40 can be configured to automatically pull out a selected one of the slidable shelves 30, or can be configured to only pull out the shelf 30 upon a separate command once the selected shelf 30 has been aligned with work surface 70. The command to push slidable shelf 30 which had been extended can occur either when commanded to retract, or when a different slidable shelf 30 is selected. Control unit 40 will not permit lift carriage 14 to move up/down when one of the slidable shelves has been extended.

In alternative embodiments, shelf receiver 106 may retract when lift carriage 14 is being raised and lowered, and will only extend when the selected shelf 30 is moving into position. In another embodiment, instead of using an "L" shaped shelf arm 80 to engage shelf receiver 106, other types of connections could be used as well, such as snap lock/release mechanisms for example, so that shelf arms 80 do not have to pass through shelf receivers 106 when carriage lift 14 is moving up/down.

Figure 13:
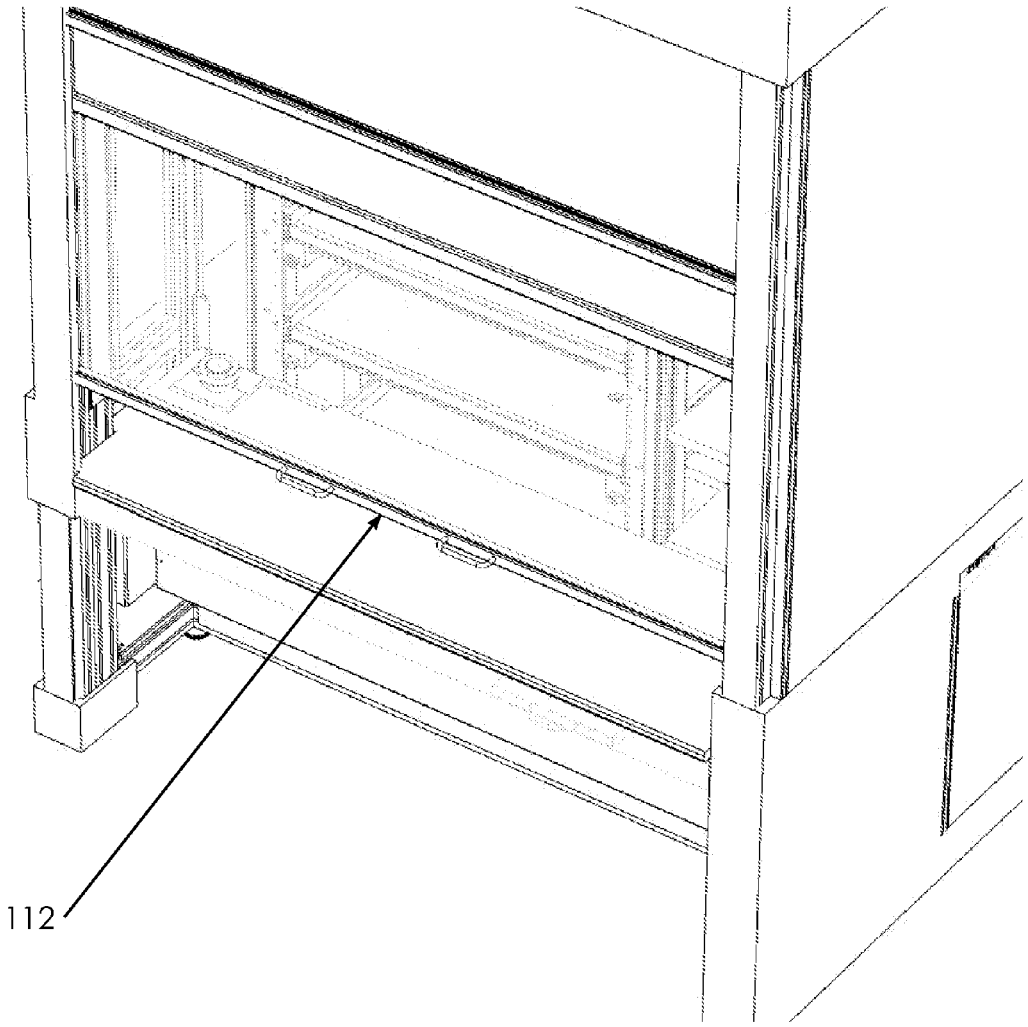
FIG. 13 illustrates a front perspective view a vertical lift system having a safety sash according to an embodiment of the present invention.

The front and back of vertical lift system 10 can have a clear, vertically-rising safety sash, glass doors, or any other types of safety panels. FIG. 13 illustrates a front perspective view of a safety sash according to an embodiment of the present invention. The safety sash can be made from glass, plastic, acrylic or any other durable material. The safety sash helps to protect people from moving components (i.e., the lift carriage 14) and helps to limit energy loss from ventilation.

Figure 14:
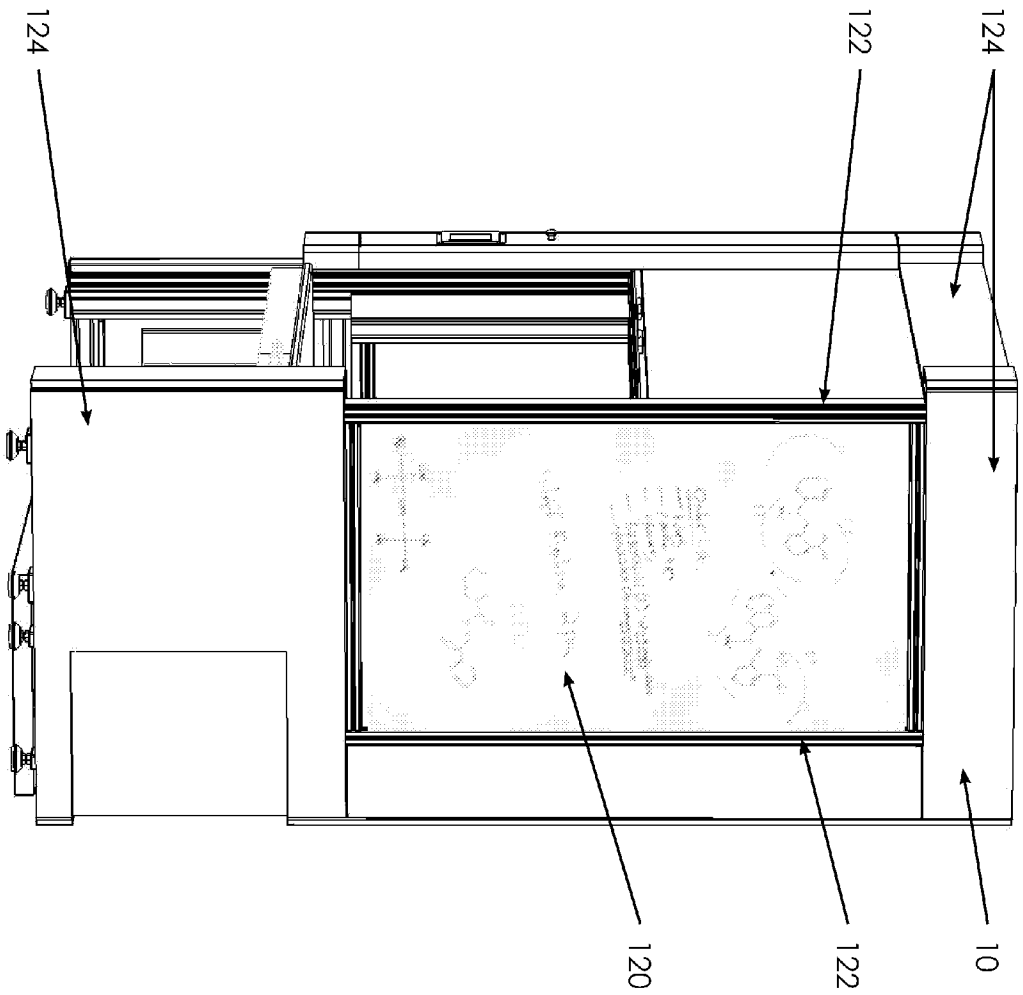
FIG. 14 illustrates a side perspective view of a vertical lift system having a switchable glass panel and mountable frame according to an embodiment of the present invention.

FIG. 14 illustrates a side view of vertical lift system containing switchable glass 120. Switchable glass 120 is mounted on the exterior sides of vertical lift system 10. Switchable glass 120 is commercially available and converts transparent viewing panels to opaque for dry-erase writing and privacy (i.e., to conceal components, equipment or cords). The operation to switch between glass 120 being transparent or clear to being opaque (e.g., white or another color) is controlled via control unit 40. Switchable glass 120 can be marked on by using commercially available erasable ink, this ink being similar to what is being used for marking or writing on white boards. The clear glass 120 can be changed to an opaque surface by activating an electric current from a switch at control unit 40. In an alternative embodiment, switchable glass 120 could be a computer display surface which has the ability to capture any writing on its surface and convert it to a digital format, viewable on a computer monitor or other display device.

Switchable glass 120 is mounted to the side of vertical lift system 10 via mountable frame 122. Mountable frame 122 can be used for easily adding accessories such as exterior shelving, large screen displays, pegboards, coat hooks or other items. Exterior shelving and large screen displays would have adjustable, locking mechanisms for locking the shelves and displays into the mountable frame 122. The mountable frame 122 could be powered for low voltage accessories or could contain accommodations for power and data cords.

FIG. 14 also shows shell 124 on the exterior of vertical lift system 10. The shell 124 is made from materials such as metals, plastics or wood for example. Shell 124 may be decorated or plain, and may have one or more colors and/or decorations.

Figure 15:
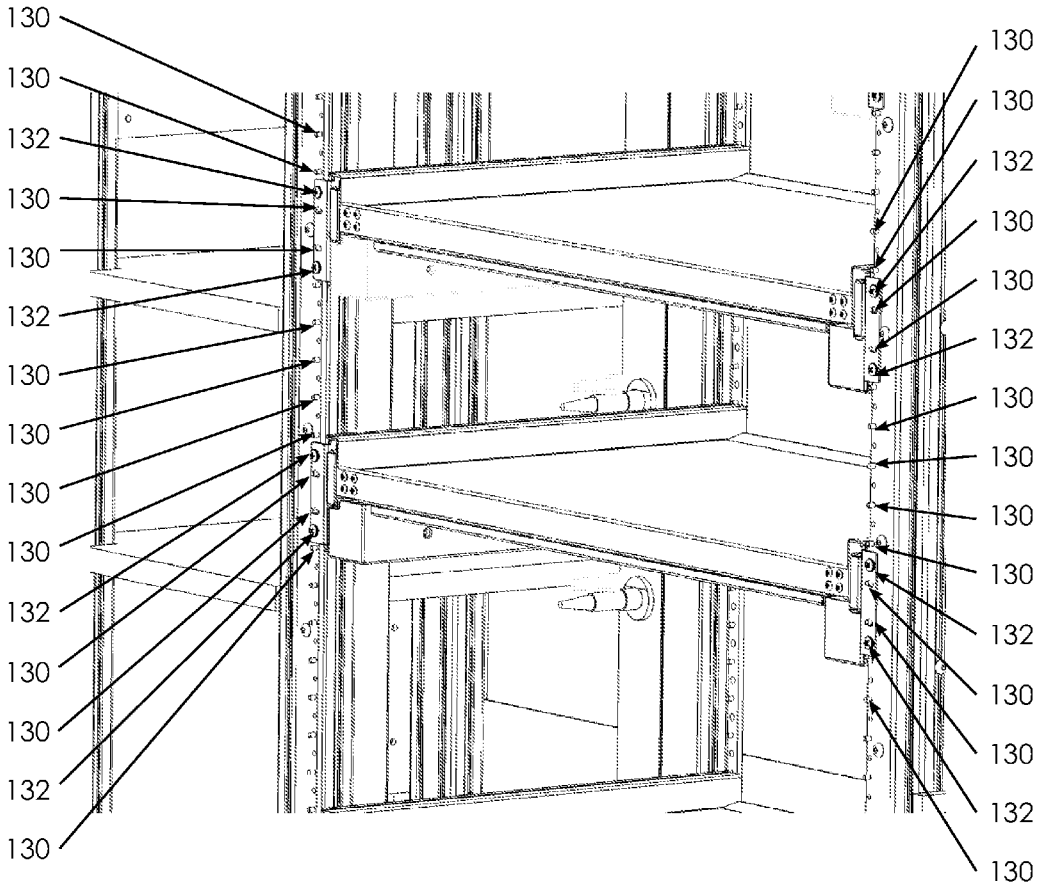
FIG. 15 illustrates a back perspective view of vertical lift system and one of the slidable shelves according to an embodiment of the present invention.

FIG. 15 illustrates a back perspective view of vertical lift system and one of the slidable shelves according to an embodiment of the present invention. On the back of the frame of lift carriage 14 and also on the backside of the front of the frame of lift carriage 14, there are evenly spaced pins 130 that stick out from the frame of lift carriage 14. Four pins 130 on each corner/column of the frame of lift carriage 14 are located on the same horizontal plane to each other, where two pins 130 on the back of frame have a corresponding set of two pins 130 on the backside of the front of the frame of lift carriage 14, and where all four pins (one at each corner) are located on the same horizontal plane. Each slidable shelf 30 has eight holes, two holes in each corner of the shelf 30. Eight pins 130 fit through eight holes of each slidable shelf 30, two holes per bracket. Two screws 132 are then fitted through the bracket on each corner of the back side of slidable shelf 30, where they align with corresponding holes in the frame of lift carriage 14. These four screws 132 securely attach slidable shelf 30 to carriage lift 14. To readjust shelf 30, the screws are 132 unscrewed, then shelf 30 is pulled from the back of carriage 14, realigning with a pair of pins 130 on each corner of carriage lift 14. Shelf 30 is then pushed into lift carriage 14 and the four screws 132 are attached to one of two brackets and lift carriage 14. Although two pins/holes are used as shown in FIG. 15 for each corner of shelf 30, it can be appreciated that one or more pins/holes can be used as well.

Figure 16:
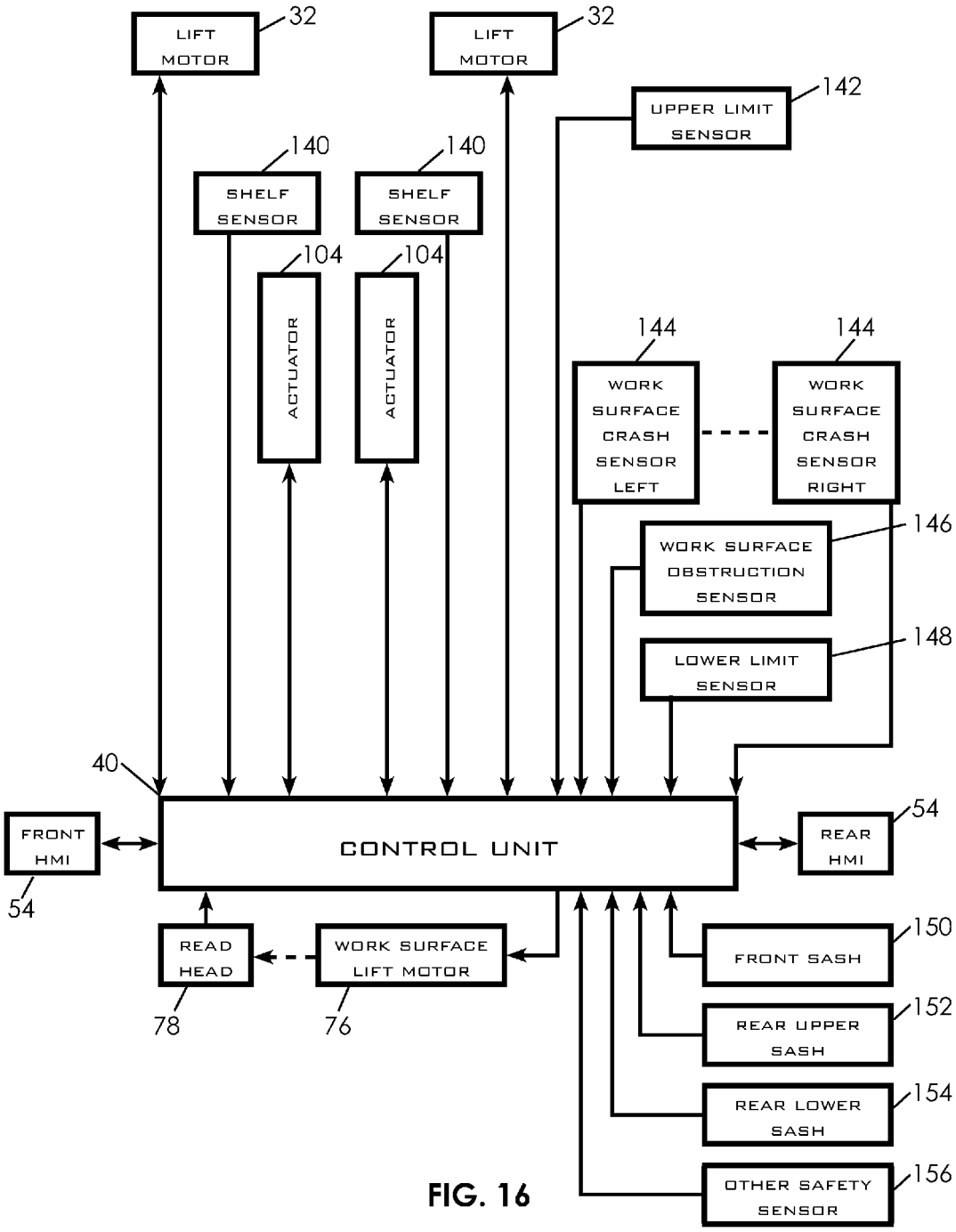
FIG. 16 shows an example configuration of control unit coupled to motors, actuators, and a variety of sensors of vertical lift system according to an embodiment of the present invention.

FIG. 16 shows an example configuration of control unit coupled to motors, actuators, and a variety of sensors of vertical lift system according to an embodiment of the present invention. Control unit 40 communicates electronically (wired or wirelessly) with motors 32, 76, 100 and actuators 104. Control unit 40 communicates electronically with a variety of sensors 56. Each of the sensors 56 indicate and determine one or more conditions or functions. Although FIG. 16 shows some of sensors 56, it can be appreciated that this is just one example of the many sensors that can be used by vertical lift system 10.

Example of some of the sensors 56 include shelf sensors 140, upper limit sensor 142, work surface crash (left and right) sensors 144, work surface obstruction sensor 146 and lower limit sensor 148. One or more shelf sensors 140 indicate where a particular shelf 28, 30 is located, whether a shelf if slidable or not, whether the shelf is extended/retracted, whether there are objects located on the shelf and whether there are objects that would prevent the shelf from retracting. Upper limit sensor 142 determines whether lift carriage 14 has been fully raised, where the bottom shelf is flush with the work surface 70. Work surface crash left/right sensors 144 determine whether there is crash of a shelf onto work surface 70, or some other condition which would indicate a crash. Work surface obstruction sensor 146 determines whether there are objects located on work surface 70 which would prevent a slidable shelf 30 from being extended. Lower limit sensor 148 determines whether lift carriage 14 is at the lowest point—where lift carriage 14 can not be further lowered inside vertical lift system 10.

There are other sensors 150, 152, 154 for determining whether a front sash, a rear upper sash and a rear lower sash are properly closed. Control unit 40 may be programmed to prohibit lift carriage 14 from moving if these sensors 150, 152, 154 indicate that the respective sash is open. Having the sashes closed during movement of lift carriage 14 helps to prevent body parts, including fingers, wrists and arms from being caught inside lift carriage 14 when it is moving.

Figure 17A:
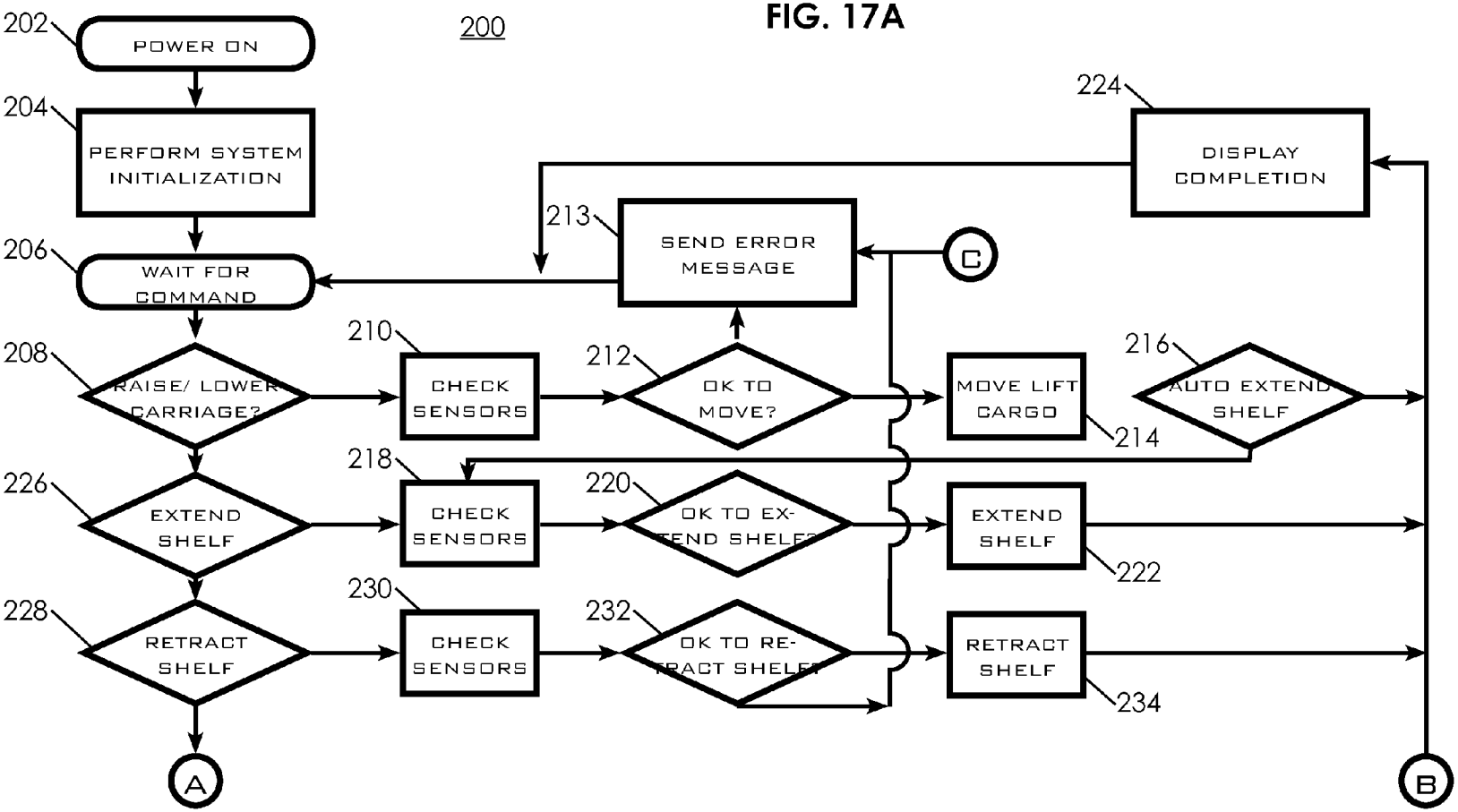
FIGS. 17A and 17B show a flowchart used by a control unit of the vertical lift system according to an embodiment of the present invention.
Figure 17B:
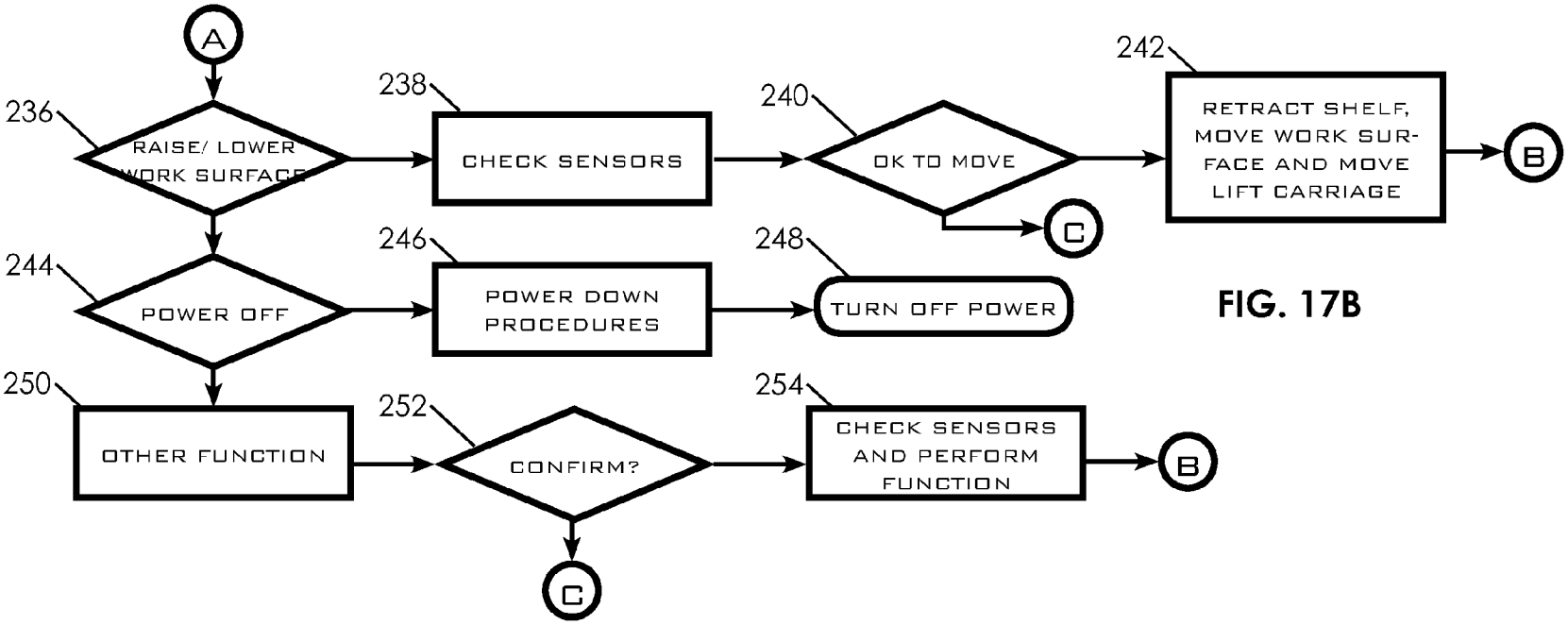

FIGS. 17A and 17B show a flowchart used by a control unit of the vertical lift system according to an embodiment of the present invention. After power is turned on in step 202, control unit 40 in step 204 performs an initial system diagnostic and initialization. Control unit 40 will check all electronic components to determine whether they are properly functioning and that there are no errors. Control unit 40 will also determine whether control unit 40 was properly shut down the previous time and/or whether there was an emergency shutdown. Control unit 40 will also check all sensors to confirm that all sashes/doors are closed and that vertical lift system can operate safely. Control unit 40 will further cycle through carriage lift 40 and determine which shelves 28, 30 are installed and their location, the height of work surface 70 and whether a shelf is slidable or non-slidable. Control unit 40 will move carriage lift 14 so the shelf identified as the bottom shelf is flush with the work surface. If there is any error, control unit 40 will display the error message(s) on an output unit 58 so that the parts/piece can be fixed. Some errors may be over-ridden, but in general, all errors should be fixed before vertical lift system 10 can be operated by a user and/or computer.

After system initialization, one of the input units 54 will wait for a command or instruction in step 206. The commands or instructions include any of the functions or features provided by vertical lift system, including for example, turning on/off internal and exterior lights, turning on/off vents, vertically moving lift carriage 14 to a particular shelf, extending/retracting a particular shelf and moving vertically the height of the work surface 70. There are many other commands and instructions than those just listed. The command or instruction is sent from one of the input units 54 and/or communication units 60 to control unit 40.

In step 208, if control unit 40 determines that the command is to raise/lower lift carriage 14 (e.g., a selection of a particular shelf), then control unit 40 checks the related sensors 56 in step 210, and if the related sensors do not indicate any errors or problems in step 212, then control unit 40 communicates with one or more motors 32 to raise/lower lift carriage 14 to the desired position in relation to work surface 70. If there are errors or problems noted by the sensors in step 210 and control unit 40 determines in step 212 that lift carriage 14 cannot be moved, then control unit 40 sends in step 213 an error message to one of the output units 58 and/or communication units 60, and returns to step 206 to wait for a command.

After lift carriage 14 has been successfully moved to the proper or predetermined position of the selected shelf in step 214, control unit 40 checks to determine in step 216 whether the shelf is a slidable shelf, and if so, determines whether the slidable shelf should be automatically extended in step 216, If the slidable shelf should be automatically extended, control unit 40 checks in step 218 the appropriate sensors 56, determines in step 220 whether sensors 56 indicate whether slidable shelf 30 can be extended without any problems, and if ok, extends in step 222 the slidable shelf 30 by controlling the shelf motor 100. Control unit 40 then sends in step 224 a message of the shelf extension to one of the output units 58 and/or communication units 60, and returns to step 206 to wait for the next command. If the slidable shelf cannot be automatically extended in step 216, control unit 40 displays in step 224 a successful completion of the movement of lift carriage 14 on one of the output units 58 and/or communication units 60, and returns to step 206 to wait for another command. Also, if the slidable shelf cannot be extended in step 220, control unit 40 sends in step 213 in an appropriate error message to one of the output units 58 and/or communication units 60, and returns to step 206 to wait for the next command.

If the command is not for raising/lowering lift carriage in step 208, control unit 40 determines in step 226 whether the command is for extending a slidable shelf. If the inputted command is for extending a slidable shelf, then control unit 40 checks in step 218 the appropriate sensors 56, determines in step 220 whether sensors 56 indicate whether slidable shelf 30 can be extended without any problems, and if ok, extends in step 222 the slidable shelf 30 by controlling shelf motor 100. Control unit 40 then sends in step 224 a message of the shelf extension to one of the output units 58 and/or communication units 60, and returns to step 206 to wait for the next command. If the slidable shelf cannot be extended in step 220 due to a failure noted by one of the sensors 56 or otherwise, control unit 40 sends in step 213 in an appropriate error message to one of the output units 58 and/or communication units 60, and returns to step 206 to wait for the next command.

If the command is not for extending a slidable shelf in step 226, control unit 40 determines whether the command is for retracting the slidable shelf in step 228. If command matches the command for retracting a slidable shelf, then control unit 40 checks in step 230 the appropriate sensors 56, determines in step 232 whether sensors 56 indicate whether slidable shelf 30 can be retracted without any problems, and if ok, retracts in step 234 the slidable shelf 30 by controlling the shelf motor 100. Control unit 40 then sends in step 224 a message of the shelf retraction to one of the output units 58 and/or communication units 60, and returns to step 206 to wait for the next command. If the slidable shelf cannot be retracted in step 232 due to a failure noted by one of the sensors 56 or otherwise, control unit 40 sends in step 213 an appropriate error message to one of the output units 58 and/or communication units 60, and returns to step 206 to wait for the next command.

If the command is not for retracting a slidable shelf in step 228, control unit 40 determines whether the command is for raising/lowering work surface 70 in step 236. If the command matches the command for raising/lowering work surface 70, then control unit 40 checks in step 238 the appropriate sensors 56 including whether a shelf had been extended. Control unit 40 then determines in step 240 whether sensors 56 indicate whether work surface 70 and lift carriage 14 can be raised/lowered without any problems, and if ok, in step 242 control unit 40 first retracts an extended shelf, raises/lowers work surface 70, and then lastly readjusts or raises/lowers lift carriage 14 so that work surface 70 is in the correct or predetermined position in relation to the current shelf of lift carriage 14. Upon successful completion, control unit 40 then sends in step 224 a message to one of the output units 58 and/or communication units 60, and finally returns to step 206 to wait for the next command. If the slidable shelf cannot be retracted or work surface 70 and/or lift carriage 14 cannot be raised/lowered in step 232 due to a failure noted by one of the sensors 56 or otherwise, control unit 40 sends in step 213 in an appropriate error message to one of the output units 58 and/or communication units 60, and returns to step 206 to wait for the next command.

If the received command is not for raising/lowering work surface 70 in step 236, control unit 40 determines whether the command is for powering down/off vertical lift system 10. If the command is for powering down, control unit 40 proceeds in step 246 to start the power down routines or procedures, ensuring that processors and memory are protected during the sequence. Once all the power down procedures have been executed, power is turned off in step 248 to the vertical lift system 10 and method 200 terminates.

If the received command is not for powering down system 10, then control unit 40 determines in step 250 what other function needs to be performed. Other commands include all other functions and features of vertical lift system 10, including for example, turning on/off interior and exterior lights, switching on/off switchable glass 120, etc. Control unit 40 may optionally confirm the command in step 252, and if confirmed, will check in step 254 the appropriate sensors 56 and perform the commanded function. Control unit 40 then displays that the command was successfully completed in step 224.

In alternative embodiments, control unit 40 may additionally confirm with the user the execution of the desired command in steps 212, 220, 232 and 240, before the command is actually executed and performed. In another alternative embodiment, the sequence of what command is checked in steps 206, 208, 226, 228, 236, 244 and 250 can be in a different order than what is shown in FIGS. 17A and 17B. For example, steps 208 and 226 can be checked before step 206. Another example is that step 244 is checked first, followed by steps 206, 208, etc.

While the inventions have been described in detail and with reference to specific embodiments thereof, it will be apparent to those skilled in the art that various changes and modifications can be made therein without departing from the spirit and scope thereof. Thus, it is intended that the present invention cover the modifications and any and all variations of these inventions and their equivalents. Additional features and advantages of the inventions will be apparent from the description, or may be learned by practice of the inventions. The objectives and other advantages of the inventions will be realized and attained by the structure particularly pointed out and described in the written description, the appended drawings and any other materials accompanying the submission of this provisional patent application. It is further to be understood that both the foregoing general description and the following detailed description are exemplary and explanatory and are intended to provide further explanation of the inventions and not to limit it.

What is claimed is:

1. A vertical lift system comprising:
a housing having at least four sides;
a lift system connected to the housing;
a lift carriage located inside the at least four sides of the housing, the lift carriage being capable of moving in the vertical direction inside the housing by the lift system;
one or more shelves connected inside the lift carriage; and
a plurality of plumbing valves attached to the lift carriage, wherein the plumbing valves are configured for at least one of dispensing and receiving at least one of a liquid, a vacuum, a gas and a waste, and wherein the plumbing valves are connected together via one of a hose and a pipe inside the lift carriage.

2. The vertical lift system of claim 1, further comprising one or more electrical outlets attached to the lift carriage.

3. The vertical lift system of claim 1, further comprising one or more data connections attached to the lift carriage.

4. The vertical lift system of claim 3, wherein the one or more data connections comprises one of USB and Ethernet.

5. A vertical lift system comprising:
a housing having at least four sides;
a lift system connected to the housing;
a lift carriage located inside the at least four sides of the housing, the lift carriage being capable of moving in the vertical direction inside the housing by the lift system;
one or more shelves located inside the lift carriage; and
a plurality of plumbing valves attached to the lift carriage, wherein some of the plumbing valves are attached together inside the lift carriage and are configured for at least one of dispensing and receiving at least one of a liquid, a vacuum, a gas and a waste.

6. The vertical lift system of claim 5, further comprising one or more electrical outlets attached to one of the lift carriage and the housing.

7. The vertical lift system of claim 5, further comprising one or more data connections attached to one of the lift carriage and the housing.

8. The vertical lift system of claim 5, further comprising:
the lift system coupled to the lift carriage and the housing; and
a control unit coupled to the lift system.

9. The vertical lift system of claim 5, wherein the one or more shelves are capable of moving in the horizontal direction.

10. A vertical lift system comprising:
a housing having at least four sides;
a lift system connected to the housing;
a lift carriage located inside the housing, the lift carriage capable of moving in the vertical direction inside the housing by the lift system;
one or more shelves located inside the lift carriage;
at least one valve coupled to the lift carriage and being configured for at least one of dispensing and receiving at least one of a liquid, a vacuum, a gas and a waste; and
one or more pipe connected to the at least one valve inside the lift carriage and capable of being connected through the top of the housing to one of a dispenser and a receiver.

11. The vertical lift system of claim 10, further comprising at least one electrical outlet attached to the lift carriage.

* * * * *